US007294073B1

(12) United States Patent
Vacek et al.

(10) Patent No.: US 7,294,073 B1
(45) Date of Patent: Nov. 13, 2007

(54) BAT HAVING A SLEEVE WITH HOLES

(75) Inventors: Matthew V. Vacek, Brownsville, MN (US); Biju Mathew, Lacrosse, WI (US)

(73) Assignee: Miken Sports, LLC, Caledonia, MN (US)

( * ) Notice: Subject to any disclaimer, the term of this patent is extended or adjusted under 35 U.S.C. 154(b) by 0 days.

(21) Appl. No.: 11/243,120

(22) Filed: Oct. 4, 2005

Related U.S. Application Data

(63) Continuation-in-part of application No. 11/135,315, filed on May 23, 2005.

(51) Int. Cl.
*A63B 59/06* (2006.01)

(52) U.S. Cl. ..... 473/566; 473/567

(58) Field of Classification Search ..... 473/564–568, 473/457, 519, 520
See application file for complete search history.

(56) References Cited

U.S. PATENT DOCUMENTS 1,530,427 A * 3/1925 Simon ..... 473/564
2,340,156 A 1/1944 Taylor et al.
2,984,486 A * 5/1961 Jones ..... 473/568
3,236,104 A 2/1966 Pape
3,392,976 A * 7/1968 Hayes ..... 473/564
3,479,030 A 11/1969 Merola
3,691,625 A 9/1972 Swenck
3,697,069 A 10/1972 Merola
3,735,463 A 5/1973 Merola
3,841,130 A 10/1974 Scott, Jr. et al.
3,854,316 A 12/1974 Wilson
3,990,699 A 11/1976 Urmston
4,025,377 A 5/1977 Tanikawa
4,036,044 A 7/1977 Yoshimura
4,089,199 A 5/1978 Siemonsen
4,330,121 A * 5/1982 McCafferty ..... 473/228
4,331,330 A 5/1982 Worst
4,569,521 A 2/1986 Mueller
4,600,193 A 7/1986 Merritt (Continued)

FOREIGN PATENT DOCUMENTS

JP 09299526 A * 11/1997

OTHER PUBLICATIONS

At least as early as 2002, Miken Sports sold its Ultra2 Softball Bat that had a composite sleeve that was thick in the middle and thin at either edge.

*Primary Examiner*—Mark S Graham
(74) *Attorney, Agent, or Firm*—Waddey & Patterson, P.C.; Phillip E. Walker; Edward D. Lanquist, Jr.

(57) ABSTRACT

Disclosed herein is a bat comprising a handle portion, a transition portion attached to the handle portion, and a barrel portion attached to the transition portion. The barrel portion includes one or more first cross-sections having a first stiffness and a plurality of second cross-sections having a second stiffness. Each first cross-section is beside one second cross-section or between two of the second cross-sections and the first stiffness is greater than the second stiffness. The variance in stiffness between the first cross-sections and the second cross-sections is created by varying the amount of material in the cross-section or by, more accurately, removing material in the second cross sections to make the second cross-sections more flexible by creating holes.

15 Claims, 3 Drawing Sheets

U.S. PATENT DOCUMENTS 4,930,772 A 6/1990 Malony et al.
5,094,453 A 3/1992 Douglas et al.
5,131,651 A 7/1992 You
5,150,897 A * 9/1992 Wortman ..... 473/567
5,364,095 A 11/1994 Easton et al.
5,415,398 A 5/1995 Eggiman
5,511,777 A 4/1996 McNeely
5,961,405 A 10/1999 MacKay, Jr.
6,022,282 A 2/2000 Kennedy et al.
6,048,283 A * 4/2000 Albarelli, Jr. ..... 473/567
6,146,291 A 11/2000 Nydigger
6,176,795 B1 * 1/2001 Schullstrom ..... 473/566
6,344,007 B1 2/2002 Feeney et al.
6,432,007 B1 * 8/2002 Filice et al. ..... 473/566
6,440,017 B1 8/2002 Anderson
6,497,631 B1 12/2002 Fritzke et al.
6,612,945 B1 9/2003 Anderson
6,733,404 B2 5/2004 Fritzke et al.
6,761,653 B1 7/2004 Higginbotham et al.
2001/0034277 A1 * 10/2001 Haringa ..... 473/457
2002/0016230 A1 2/2002 Okuyama et al.
2004/0152545 A1 8/2004 Fritzke

* cited by examiner

BAT HAVING A SLEEVE WITH HOLES

This is a continuation-in-part application claiming priority based upon co-pending U.S. patent application Ser. No. 11/135,315 filed May 23, 2005 entitled "Bat with Enlarged Sweet Spot."

A portion of the disclosure of this patent document contains material that is, subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications discussed herein are hereby incorporated by reference in their entirety.

BACKGROUND OF THE INVENTION

The present invention relates generally to baseball and softball bats. More particularly, the invention relates to a bat having a sleeve with holes.

It can be appreciated that numerous attempts have been made to improve the performance of a bat. These prior attempts have included the addition of various shells, inserts, materials, and shapes of the bat in order to improve its performance or usage. For example, U.S. Pat. Nos. 6,733,404, 6,497,631, 6,176,795, 6,022,282, 4,930,772, 4,331,330, and 3,990,699, and U.S. patent application Publication No. 2002/0016230 disclose various attempts to improve the performance or use of a bat.

The performance of a bat is generally based upon the weight of the bat, size of the bat, and the impact response of the bat at and during impact with a ball. Most of the focus for improvements in bat technology has been in improving the performance of the preferred impact area, or sweet spot. As the prior art bats have increased the performance in this area, many of the sports regulatory agencies have placed performance and/or configuration restrictions on the bats. These restrictions have mandated new innovations in the development of the bat technology.

For example, one regulatory body requires a maximum performance from a bat when impacted in the preferred impact area or sweet spot of the bat. Typically, this location is approximately six inches from the end of the bat. As such, the current maximum performance for the bat in its preferred hitting area is limited by these regulations. However, it is also to be understood that the area to either side of the sweet spot on a prior art bat has a significant drop off in performance.

The contemporary bat art has made few attempts to improve the performance of the bat sections adjacent the preferred impact area. As such, the performance of the bats in areas distal from, and even adjacent to, the sweet spot dramatically drops for the conventional bats. However, these attempts have drawback.

For example, U.S. patent application Publication 2004/0152545 discloses increasing the thickness over the sweet spot of the barrel in order to increase the leaf spring effect of the bat. However, this patent application publication fails to reduce the thickness of any wall within the bat in order to increase performance of the bat. As such, this patent application publication increases the weight of the bat in an attempt to increase the performance of the bat, which is counter productive. This patent application publication also increases the cost of the bat by increasing the amount of material used. Additionally, when there is a portion of a bat that has a change in diameter, that portion becomes a weakened spot. Additionally, the differences in spacing between portions of the body and of the frame can create weaknesses. Further, the differences in distance between the body and frame can cause manufacturing issues as to how to fill the variable distances and how to maintain the variable distances during construction of the bat. Further, this published application discloses placing slots in one end of the bat to reduce the diameter of that end of the insert to more easily place an insert into a bat frame but fails to understand the benefits of placing the slots in both end of the sleeve as to increasing the flexibility of the bat hitting portion beyond the center of the barrel. Further, the slots are not sufficient in length to increase the size of the sweet spot.

Thus, there is a continuing need for improved overall performance of bats. These improved bats need to conform to the regulatory agencies' restrictions in the preferred hitting zone while performing well beyond the preferred hitting zone. This needed bat should increase the stiffness in the preferred hitting zone as compared to the area(s) adjacent the preferred hitting zone. This needed bat must not have inconsistent spaces between the sleeve and the hitting portion. As such, what is needed is a bat that varies the stiffness of the wall of the bat in order to enhance performance of the bat.

BRIEF SUMMARY OF THE INVENTION

Disclosed herein is a bat comprising a handle portion, a transition portion attached to the handle portion, and a barrel portion attached to the transition portion. The barrel portion includes one or more first cross-sections having a first stiffness and a plurality of second cross-sections having a second stiffness. Each first cross-section is beside one second cross-section or between two of the second cross-sections and the first stiffness is greater than the second stiffness. The variance in stiffness between the first cross-sections and the second cross-sections is created by varying the amount of material in the cross-section or by, more accurately, removing material in the second cross sections to make the second cross-sections more flexible by creating holes. Likewise, a bat may be provided with third cross sections on the sides of the second cross-sections distal from the first cross-section whereby the third cross-sections are less stiff than the second cross-sections because more material is removed. Spacers may be added to holes to prevent rough surfaces and gaps.

It is therefore a general object of the present invention to provide a bat having variable wall stiffness.

Still another object of the present invention is to provide a bat having varying amounts of materials in different cross sections of the bat.

Yet still another object of the present invention is to enlarge the effective preferred hitting area of the bat.

Another object of the present invention is to provide a bat having an enlarged sweet spot.

Yet still another object of the present invention is to increase the length of the barrel/sweet spot without adding additional weight to the bat.

Yet another object of the present invention is to decrease the wall stiffness on either or both sides of the main hitting area.

And yet another object of the present invention is to provide a bat that increases the performance of the bat in sections of the bat adjacent to the main hitting area.

Yet another object of the present invention is to provide a bat which meets regulatory standards in the preferred hitting area as well as the areas adjacent to it.

Yet another object of the present invention is to provide material that can be placed in the holes to prevent rough surfaces and/or to prevent gaps.

Other and further objects, features and advantages of the present invention will be readily apparent to those skilled in the art upon reading of the following disclosure when taken in conjunction with the accompanying drawings.

DETAILED DESCRIPTION OF THE INVENTION

Figure 1:
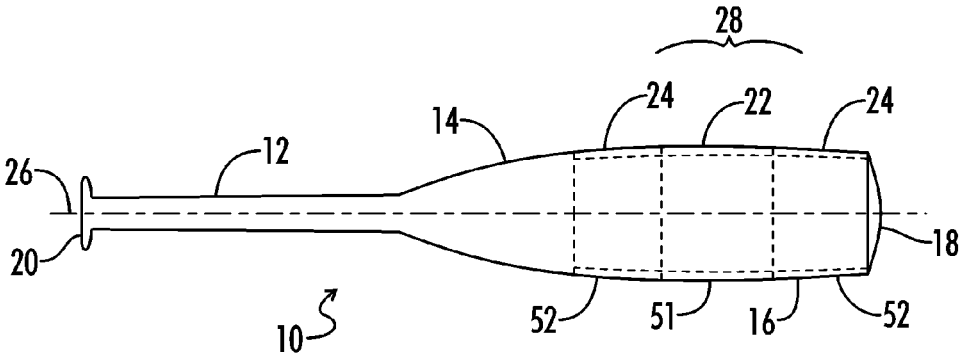
FIG. 1 is a side view of a bat made in accordance with the current disclosure.
Figure 3:
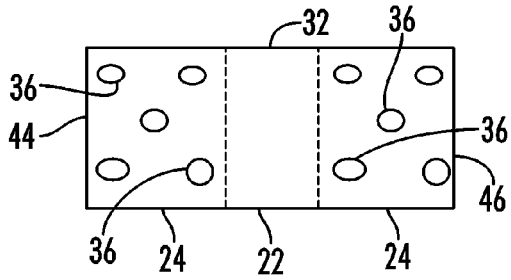
FIG. 3 is a side view of yet another embodiment of the sleeve of the present invention.

Referring generally now to FIGS. 1 and 3, there is shown generally at 10 one embodiment of the bat of the present invention. The bat 10 comprises a handle portion 12, a transition portion or taper portion 14, and a barrel portion 16. The transition portion 14 is preferably attached to the handle portion 12, while the barrel portion 16 is attached to the transition portion 14. An end cap 18 is traditionally placed on the end of the barrel portion 16 distal from the taper 14. A knob 20 is traditionally attached to the handle 12 on the end of the handle 12 distal from the barrel portion 16. Each bat has a preferred hitting section 28 that can also be called the sweet spot. In a traditional bat, the preferred hitting portion 28 lies in the middle portion of the barrel portion. For the purposes of this application, the area proximal the central part of the barrel portion 16 is the first cross-section 22. The area on either or both sides of the barrel portion will be called the second cross-section 24.

One focus of the present invention is to make the first cross-section 22 stiffer than the second cross-sections 24. By doing this, the first cross-section 22, because it is the center of percussion will continue to be the best performing portion of the bat. However, by making the second cross-sections 24 more flexible, the sweet spot will extend well into the second cross sections 24 as opposed to remaining virtually exclusively in the first cross-section 22.

Referring now to FIG. 3, there is shown generally at 32 an embodiment of the sleeve of the present invention. In this embodiment, material is removed from the second cross-section 24 in the form of holes 36. In this embodiment, holes 36 are circular in shape and evenly sized and spaced over exclusively the second cross-section. The mere fact that the holes 36 remove material from the sleeve 32 causes the sleeve 32 to be much more flexible in hoop stiffness in the second cross-section where the holes 36 are removed as compared to the first cross-section 22 where little or no material has been removed.

Figure 2:
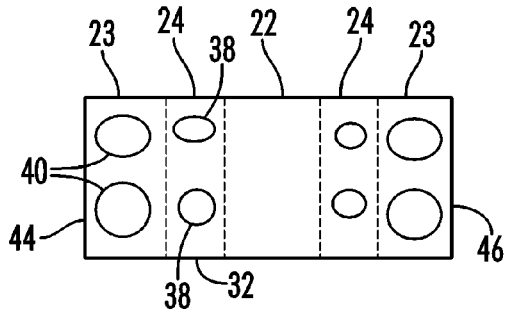
FIG. 2 is a side view of one embodiment of a sleeve of the present invention.

The sleeve portion 32 of a second embodiment of the present invention is shown in FIG. 2. The sleeve 32 has a series of holes 36 of varying sizes. In the embodiment of FIG. 2, the sleeve has first holes 38 removed from the second cross-section 24 and larger second holes 40 removed from the third cross-sections 23. Because more material is removed from the third cross-sections 23 than from the second cross-sections 24, the third cross-sections 23 are more flexible than the second cross-sections 24 which are more flexible than the first cross-section 22. For a point of reference only, and not necessarily as a functional reference, sleeve 32 has a taper end 44 that is preferably aligned proximal to or along the taper portion 14 of the bat 10 and a distal end 46 that is preferably aligned proximal to or attached to the end cap 18 of the bat 10. Thus, in the preferred embodiment, holes 36 may be larger or more numerous closer to either end 44, 46.

Figure 4A:
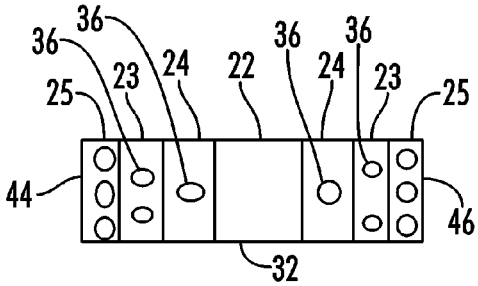
FIG. 4A is a side view of yet another embodiment of the sleeve of the present invention.
Figure 4B:
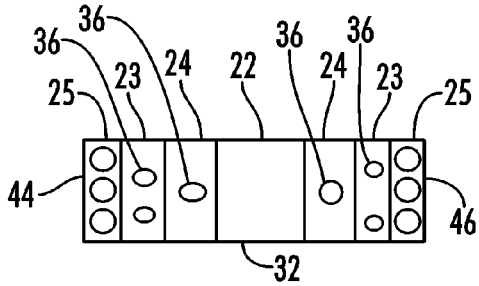
FIG. 4B is a side view of yet another embodiment of the sleeve of the present invention.

Referring now to FIG. 4, there is shown generally at 32 another embodiment of the sleeve of the present invention. In this embodiment, material is removed from the second cross-sections 24, the third cross-sections 23, and fourth cross-sections 25 located on either side of the sleeve 32, In this embodiment, more holes 36 are placed in the fourth cross-sections 25 than in the third cross-sections 23. Likewise, more holes are placed in the third cross-sections 23 than in the fourth cross-sections 24. Thus, the fourth cross-sections 25 have a stiffness S4 that is less than the third cross-sections 23 which have a stiffness S3 which is less than the second cross sections 24 which has a stiffness S2 less than the stiffness S1 of the first cross-section 22. Although this embodiment shows the holes 36 being in a symmetrical arrangement, any order may be used.

Figure 5:
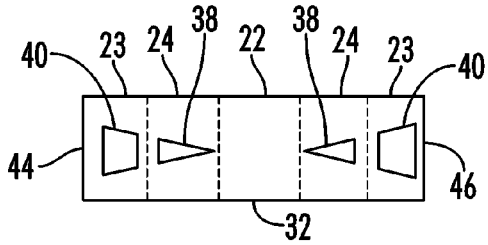
FIG. 5 is a side view of yet another embodiment of the sleeve of the present invention.

FIG. 5 is a variation on the theme combining the techniques of the other embodiments. In this embodiment, holes 36 are wide proximal the ends 44, 46 and narrower proximal the first cross-section 22. As a result, more material is removed from the third cross-section 23 than from the second cross-section 22 that have more material removed than the first cross section. As a result, the first cross-section 22 is stiffer than the second cross-section 24 which is stiffer than the third cross-section 23. In the orientation shown in FIG. 5, the width of the hole 36 is wider at either end 44, 46 than proximal the second cross-section 24 which is wider than proximal the first cross-section 22. Additionally, FIG. 5 also shows than angular holes may be used instead of rounded holes.

Figure 6:
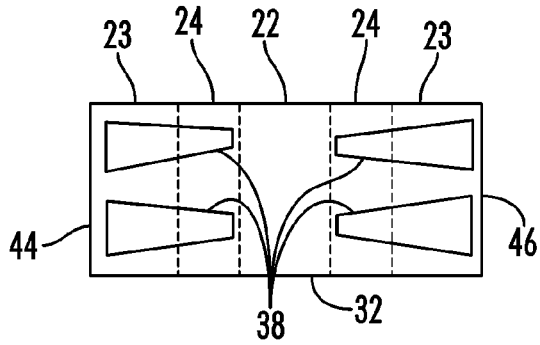
FIG. 6 is a side view of yet another embodiment of the sleeve of the present invention.
Figure 7:
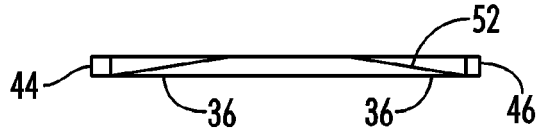
FIG. 7 is a cutaway view showing the holes in FIG. 6.

It should be understood that although FIGS. 2-5 show embodiments in which all of the material is removed from the respective holes 36, material may be left in by merely thinning the wall of the sleeve 32 at those points. FIGS. 6-7 shows such an embodiment. In this embodiment, holes 36 are merely thinner portions of the sleeve 32. However, the depth of the hole, 40 in this instance, is greater at the ends 44, 46 and less proximal to the first cross-section 22. The same variations in depth from the ends 44, 46 can be used for the other shapes shown in FIGS. 2-5. By removing more material proximal to the ends 44, 46, the sleeve 32 is more flexible proximal to the ends 44, 46. In the preferred embodiment, material is removed gradually from the ends 44, 46 to the termination of the respective hole 36 as shown in FIG. 7*a*.

Likewise, we refer to the sleeve 32 as being either a shell or an insert.

Figure 8:
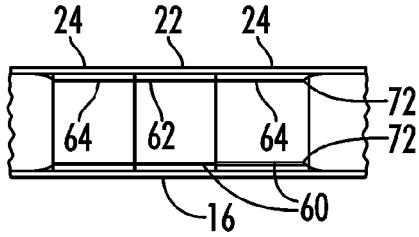
FIG. 8 is a side view of yet another embodiment of the sleeve of the present invention.

FIG. 8 shows yet another embodiment of the present invention. In this embodiment, the sleeve 32 is made of at least two and preferably three rings. The first ring or material 62 located adjacent second ring or material(s) 64. The first ring 62 is placed within the barrel portion 16 proximal to the first cross-section 22. The second ring 64 is placed within the barrel portion 16 on either or both sides of the first ring 62 to lie within either or both second cross-sections 24. The first ring 62 is stiffer than the second ring 64 thereby making the stiffness S1 of the first cross-section 22 greater than the stiffness S2 of the second cross-section 24. The rings 62 and 64 may be joined together. Also, an envelope 72 may be provided to join at its end to the sleeve 62 to hold the rings 62 and 64 in place. The holes described herein can be placed in any of the rings 60 as necessary to make the second cross-sections 24 more flexible that the first cross-section 22.

In the preferred embodiments, the sleeve 32 and the shell 30 are force or press fit over each other. However, some adhesive can be used in addition to the envelope discussed above.

In the preferred embodiment of FIG. 3, the barrel is substantially 12.00 inches long, the first cross-section is substantially 2.00 inches long, and each second cross-section is substantially 5.00 inches long.

In the preferred embodiment of FIG. 2, the barrel is substantially 12.00 inches long, the first cross-section is substantially 2.00 inches long, each second cross-section is substantially 2.00 inches long, and each third cross-section is substantially 3.00 inches long.

In the preferred embodiment of FIG. 4, the barrel is substantially 12.00 inches long, the first cross-section is substantially 2.00 inches long, each second cross-section is substantially 2.00 inches long, each third cross-section is substantially 2.00 inches long, and each fourth cross-section is substantially 1.00 inches long.

It should also be understood that sleeve 32 may be secured to barrel 16 along its entire length or only over a portion. For example, the first cross-section 22 could be secured to the barrel 16 leaving the second cross-section 24 to move independently.

It should be understood that bat 10 and sleeve 32 may be constructed from any material including metal, alloys, rubber, and composites. The preferred material for the frame is composite material while the preferred material for the sleeve is some type of metal such as aluminum or titanium. In the preferred embodiment, holes are made by cutting with a router or saw although a laser may be used.

It should be understood that holes 36 may be filled in with a spacer material (52 in FIG. 7*a*) that either does not affect the flexibility created by the holes or affects it very minimally. This spacer material 7*a* may be rubber or a powder metal that provides little if any stiffness but prevents the outer or inner surface of the sleeve 32 from having rough surfaces and prevents gapes between the sleeve 32 and the barrel portion 16.

Figure 9:
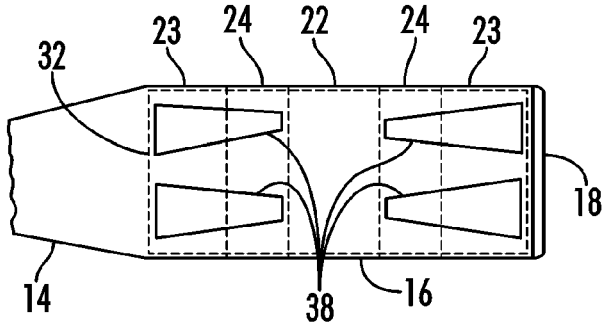
FIG. 9 is a side view of an alternative embodiment of the present invention.
Figure 10:
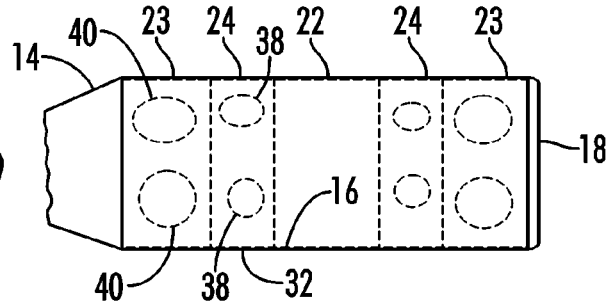
FIG. 10 is a side view of an alternative embodiment of the present invention.

FIGS. 9 and 10 demonstrate that the holes 36 may be placed in the bat 10 instead of a sleeve 32. FIG. 9 shows still another embodiment wherein the barrel portion 16 of the bat has the holes 36 to create the various cross-sections shown in the other Figures. In this embodiment, a sleeve 32 is provided inside the barrel portion 16. However, a sleeve 32 is not necessary. FIG. 10 is yet another embodiment with the holes 38, 40 being placed in the barrel portion 16 of the bat 10 with a sleeve 32 being placed over the barrel portion 16.

If the holes 36 are exposed, then spacers 48 may be used to fill in the holes 36. A film may be placed over the filled holes.

Thus, although there have been described particular embodiments of the present invention of a new and useful Bat with a Sleeve Having Holes, it is not intended that such references be construed as limitations upon the scope of this invention except as set forth in the following claims.

What is claimed is:

1. A bat having a sleeve having a taper end and a distal end, the sleeve comprising:

a first cross-section and a pair of second cross-sections adjacent to each end of the first cross section, the sleeve having first holes in each of the second cross sections; and a third cross-section on the side of each of the second cross-sections distal from the first cross section, the sleeve having second holes in each of the third cross sections that are more numerous than the first holes.

2. The bat of claim 1 wherein the sleeve further comprises a fourth cross-section on the side of each of the third cross-sections distal from the first cross section, the sleeve having third holes in each of the third cross sections that are more numerous than the second holes.

3. The bat of claim 1 wherein the hole decreases in depth from the ends to the first cross section.

4. The bat of claim 1 further comprising the first cross-section being a first ring and the second cross-sections being second rings.

5. The bat of claim 4 further comprising an envelope for holding the sleeve proximal the barrel portion.

6. A bat having a sleeve having a taper end and a distal end, the sleeve comprising:

a first cross-section and a pair of second cross-sections adjacent to each end of the first cross section, the sleeve having first holes in each of the second cross sections wherein the first cross-section is attached to the bat but the second cross-section is not.

7. A bat having a sleeve having a taper end and a distal end, the sleeve comprising:

a first cross-section and a pair of second cross-sections adjacent to each end of the first cross section, the sleeve having first holes in each of the second cross sections wherein the first cross-section is adhered to the bat but the second cross-section is not.

8. A bat having a barrel portion and a sleeve, the sleeve comprising:

a first cross-section;

a second cross-section on each side of the first cross section, each second cross-section having first holes;

a third cross-section adjacent to each of the second cross-sections distal from first cross-section, each the third cross-section having second holes larger than the first holes; and a fourth cross-section adjacent to each of the third cross-sections distal from second cross-sections, each the fourth cross-section having third holes larger than the second holes.

9. The bat of claim 8 wherein the depth of the first holes is greater proximal the first cross-section than distal the first cross-section.

10. The bat of claim 8 further comprising a spacer for filling at least one of the holes.

11. A bat having a hitting portion, a taper portion and a distal portion, the hitting portion comprising:

a first cross-section and a pair of second cross-sections adjacent to each end of the first cross section, the hitting portion having first holes in each of the second cross sections; and a third cross-section on the side of each of the second cross-sections distal from the first cross section, the hitting portion having second holes in each of the third cross sections that are more numerous than the first holes.

12. The bat of claim 11 wherein the hole decreases in depth from the ends to the first cross section.

13. The bat of claim 11 further comprising a sleeve.

14. A bat comprising:

a taper portion;

a distal portion;

a hitting portion comprising a first cross-section and a pair of second cross-sections adjacent to each end of the first cross section, the hitting portion having first holes in each of the second cross sections;

a sleeve; and wherein the first cross-section is attached to the sleeve but the second cross-section is not.

15. A bat comprising:

a taper portion;

a distal portion;

a hitting portion comprising a first cross-section and a pair of second cross-sections adjacent to each end of the first cross section, the hitting portion having first holes in each of the second cross sections;

a sleeve; and wherein the first cross-section is adhered to the sleeve but the second cross-section is not.

* * * * *